US006682410B2

(12) United States Patent
Fujishiro

(10) Patent No.: US 6,682,410 B2
(45) Date of Patent: Jan. 27, 2004

(54) BARREL CONTAINER FOR USE WITH DRY BARREL POLISHING

(75) Inventor: Akihito Fujishiro, Aichi (JP)

(73) Assignee: Tipton Corp., Aichi (JP)

( * ) Notice: Subject to any disclaimer, the term of this patent is extended or adjusted under 35 U.S.C. 154(b) by 0 days.

(21) Appl. No.: 09/910,912

(22) Filed: Jul. 24, 2001

(65) Prior Publication Data

US 2002/0013125 A1 Jan. 31, 2002

(30) Foreign Application Priority Data

Jul. 26, 2000 (JP) ..... 2000-225779

(51) Int. Cl.[7] ..... B24B 31/00
(52) U.S. Cl. ..... 451/326; 451/113
(58) Field of Search ..... 451/326, 328, 451/329, 32, 104, 113

(56) References Cited

U.S. PATENT DOCUMENTS 3,078,623 A * 2/1963 Stanley ..... 451/328
3,341,979 A * 9/1967 Davidson et al. ..... 451/329
3,707,058 A * 12/1972 Anderson et al. ..... 451/326
4,615,148 A * 10/1986 Harper, Jr. ..... 451/326
5,454,749 A * 10/1995 Ohno ..... 451/329
5,672,094 A * 9/1997 Nishimura et al. ..... 451/328

FOREIGN PATENT DOCUMENTS

| | | |
|---|---|---|
| JP | 57-075775 | 5/1982 |
| JP | 09-314455 | 12/1997 |
| JP | 10-71553 | 3/1998 |

* cited by examiner

*Primary Examiner*—Robert A. Rose
(74) *Attorney, Agent, or Firm*—Wenderoth, Lind & Ponack L.L.P.

(57) ABSTRACT

A barrel container for a dry barrel polishing machine includes a container body made of an elastic material and having an access opening through which polishing chips and workpieces are put into the container body. The container body has a wall with a through hole providing communication between an exterior and an interior of the container body, and a lid opening and closing the access opening.

12 Claims, 14 Drawing Sheets

BARREL CONTAINER FOR USE WITH DRY BARREL POLISHING

BACKGROUND OF THE INVENTION

1. Field of the Invention

This invention relates generally to dry barrel treating machine grinding, polishing or cleaning workpieces, and more particularly to a barrel container used with a dry barrel polishing machine.

2. Description of the Related Art

One type of barrel polishing machines uses a rotational barrel container. The barrel container includes a container body having an opening and a lid closing the opening of the container body. The container body comprises a casing generally made of steel and a lining made of an elastic material and attached to an inner wall of the casing. The lining relieves collision of polishing chips and workpieces against an inner wall of the barrel container during polishing, thereby preventing the steel wall of the container from wear. The lid also includes a steel base and a lining attached to the inside of the base. One or more barrel containers are mounted on a barrel polishing machine.

The aforesaid steel casing is made by bending a steel plate 39 as shown in FIGS. 10 to 12. For example, a container body 47 as shown in FIG. 12 has a hexagonal section and includes an opening 40 formed in one of the six sides thereof. In the manufacture of the container body 47, a steel plate 39 is bent so as to have a hexagonal section. Thereafter, two hexagonal steel plates 42 are welded to both open ends of the container body, respectively, so that a hollow casing 41 is formed. Previously divided cores 44*a* and 44*b* are then inserted through the opening 40 into the casing 41. The divided cores 44*a* and 44*b* are connected together in the casing 41 to be assembled into an integral core 44. A bridge member 31 is mounted between flanges 45 formed along peripheral edges of the opening 40. The core 44 is then hung on the bridge member 31. A material for a lining 46, for example, molten polyurethane resin, is poured into a space between an inner wall of the casing 41 and the core 44. The molten resin is cooled to be solidified such that a barrel polishing container 47 with the polyurethane lining 46 is formed.

There are two types of barrel polishing machines, namely, dry barrel polishing machines using no water and wet barrel polishing machines using water. In view of environmental protection and economy in treating costs, the dry barrel polishing machines have recently been predominant. Japanese Patent No. 2643103 discloses a barrel container used in the dry polishing. The disclosed barrel container includes an external air intake portion or vent formed in the casing or the lid for introducing external air into the casing. The container further includes a dust exhaust portion formed in the casing or the lid for exhausting dust resulting from polishing. The barrel container is attached to a polishing machine and rotated so that polishing chips and workpieces are moved at high speeds in the barrel container. As a result, the workpieces are polished. During polishing, air is drawn through the external air intake into the barrel container by the operation of a dust collector. The drawn air is caused to flow through the polishing chips and workpieces in the barrel container to thereby cool them. Furthermore, dust resulting from polishing is exhausted through the dust exhaust portion to the dust collector side. Thus, loading of the polishing chips due to dust resulting from polishing, which is a problem peculiar to the dry polishing, can be prevented.

There are two methods of manufacturing the barrel container for dry barrel polishing machines. In one method, the steel body 41 is made in the same manner as described above and thereafter, molten polyurethane or the like is cast into the lining 46 which is attached to an inner wall of the body. Subsequently, a plurality of small holes 50 are formed so as to serve as the external air intake and the dust exhaust portion. The polishing chips and workpieces cannot pass through the holes 50. See FIG. 13A. In the other method, a large vent 51 is formed in the body 41. The lining 46 with another vent 52 slightly larger than the vent 51 is cast. Thereafter, a polyurethane piece 5 having small holes 4 is fitted with the vent 52 by bolts etc. as shown in FIG. 13B. Each hole 4 has such a diameter that the polishing chip and workpiece cannot pass therethrough.

In the former method, however, both body 41 and lining 46 need to be simultaneously drilled. It is difficult to form such a small hole, as the holes 50, through which the polishing chips and workpieces cannot pass. The reason for this is that a small hole is closed upon extraction of a drill since polyurethane is an elastomer. Even if holes should be formed, end faces of the holes 50 would be deteriorated as the result of drilling. As a result, the end faces of the holes 50 would be worn such that peripheral portions of the holes are partially worn. The partial wear of the peripheral portions of the holes necessitates replacement of the overall lining, increasing the manufacturing cost.

In the latter method, a steel plate with vent holes 51 is bent into the steel body 41. Thereafter, when the lining is formed, dummy molds are fitted with the vents 51 and 52, respectively, so that the material for the lining can be prevented from flowing into the vents 51 and so that the vents 52 are formed in the lining 46 after completion of the lining. The dummy molds are removed after the material for the lining has been solidified. The polyurethane piece 5 having small holes 4 through which the polishing chips and workpieces cannot pass is attached to the vents 52 by bolts. However, since the steel body 41 has a definite limitation of accuracy with regard to the bending, spring back sometimes results in distortion as shown in FIG. 14 after bending. As a result, a space between the body 41 and the core 44 becomes non-uniform when the lining 46 is formed. One vent 51 is displaced such that a thickness of the lining becomes non-uniform. When the polyurethane piece 5 is fixed to the vent 52 by bolts, a difference results between a thickness of the piece 5 and the thickness of the lining of the vent 52. This difference causes the aforesaid partial wear. A downward force is applied to the body 41 from above particularly when the lid is closed, whereupon the distortion is increased. This increases the difference between the thicknesses of the piece 5 and the lining, resulting in a gap.

Further, polishing chips and workpieces are moved at high speeds in the barrel container in the dry barrel polishing. Accordingly, the polishing chips and workpieces repeatedly collide against the lining wall. When the workpieces are soft, the collision results in marks on the workpieces. Water serves as a buffer in the conventional wet polishing, thereby preventing forming of the marks on the workpieces. Accordingly, the conventional barrel container for the wet barrel polishing has a high hardness from the view point of wear resistance. However, when the container for the dry barrel polishing has the same hardness as that of the wet barrel polishing, the aforesaid marks are formed on the workpieces.

SUMMARY OF THE INVENTION

Therefore, an object of the present invention is to provide a barrel container which has an inner wall with no difference in thickness in spite of the presence of a vent, and in which it is difficult for workpieces to incur marks due to collision against the inner wall.

The present invention provides a barrel container for a dry barrel polishing machine, comprising a container body made of an elastic material and having an access opening through which polishing chips and workpieces are put into the container body. The container body has a wall with a through hole providing communication between an exterior and an interior of the container body, and a lid opening and closing the access opening is provided.

According to the above-described barrel container, the container body is made of the elastic material although the conventional casing body is made of steel. Accordingly, the container body has a uniform thickness in spite of the presence of the vents. There is no difference in the thickness even when a piece having the same thickness and formed with small holes is attached to the container body. Furthermore, since the container body is made of the elastic material such as the polyurethane resin, it is light-weight, and a load for carrying the barrel container can be reduced. Furthermore, when the container body is made of the polyurethane resin with high wear and abrasion resistance, the barrel container can be used for a long period of time. Moreover, since the container body of the barrel container has a larger thickness than the lining of the conventional container body made of steel, the service life of the barrel container can further be improved. Additionally, shock due to the collision of workpieces against the inner wall of the container body can be reduced in the dry barrel polishing as compared with the case of the wet barrel treatment. Thus, the marks due to the collision can be reduced.

In a preferred form, the elastic material is polyurethane. In this case, the polyurethane preferably has a hardness ranging between 60 and 80 in ISO 7619 Shore A durometer hardness. Consequently, shock due to the collision of workpieces against the inner wall of the container body can be reduced in the dry barrel polishing as compared with the case of the wet barrel treatment. Thus, the marks due to the collision can be reduced.

In another preferred form, the container body has a hole formed in the wall thereof. In this case, the barrel container further comprises a piece made of an elastic material and having a number of small holes, with the piece being attached to the hole of the wall of the container body. Additionally, the barrel container further comprises a plate mounted on an outer wall of the container body so as to cover the hole, with the plate having air permeability. In this case, the piece is bolted to the plate at an inner wall of the container body.

In a further preferred form, the barrel container further comprises a barrel casing enclosing the container body with a space being defined in the barrel casing so as to communicate via the through hole of the container body with an interior of the container body, and a hollow shaft supporting the barrel container so that the barrel container is rotatable. The shaft has a communication passage defined therein so as to provide communication between the space in the barrel casing and a dust collector.

In still another preferred form, the container body has a hexagonal section and includes two peripheral sides adjacent to the access opening, and a bottom. The peripheral sides and bottom are formed with a plurality of the through holes respectively. The bottom communicates with the space in the barrel casing for exhaust of air, and the two peripheral sides communicate via the barrel casing with an exterior of the barrel casing for intake of air.

BRIEF DESCRIPTION OF THE DRAWINGS

Other objects, features and advantages of the present invention will become clear upon reviewing the following description of preferred embodiments, made with reference to the accompanying drawings, in which.

DETAILED DESCRIPTION OF THE PREFERRED EMBODIMENTS

Figure 1:
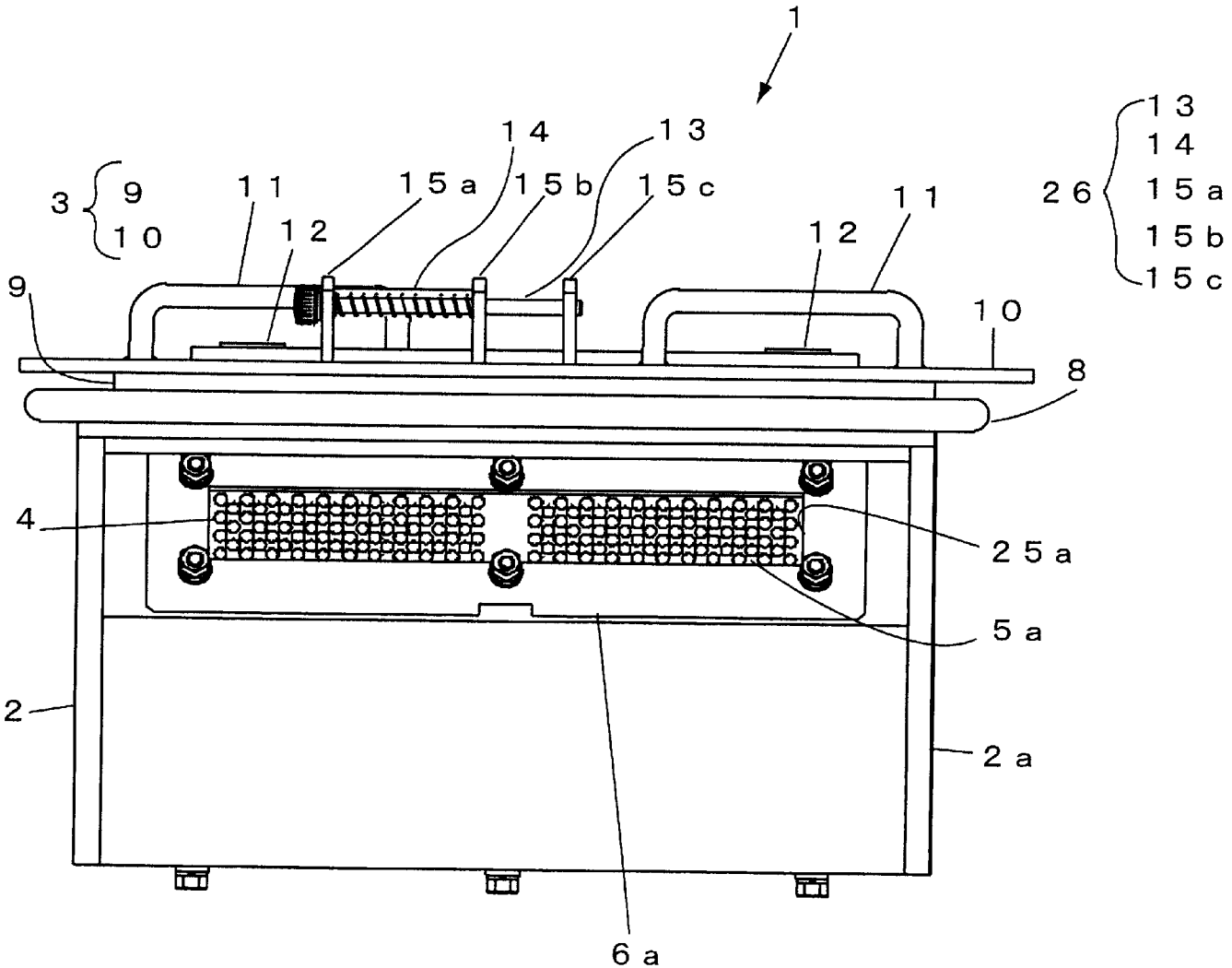
FIG. 1 is a front view of a barrel container of one embodiment in accordance with the present invention.
Figure 2:
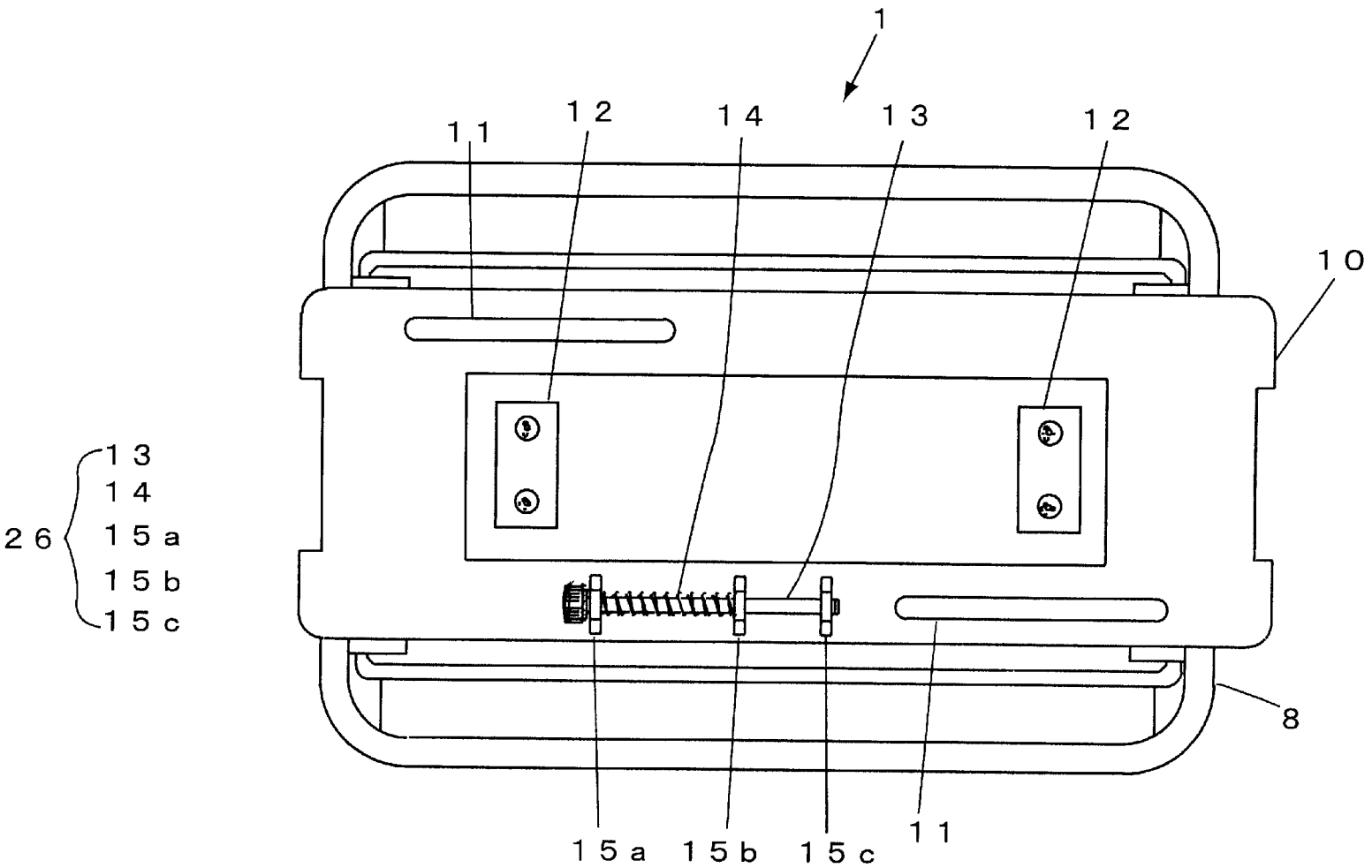
FIG. 2 is a plan view of the barrel container.
Figure 3:
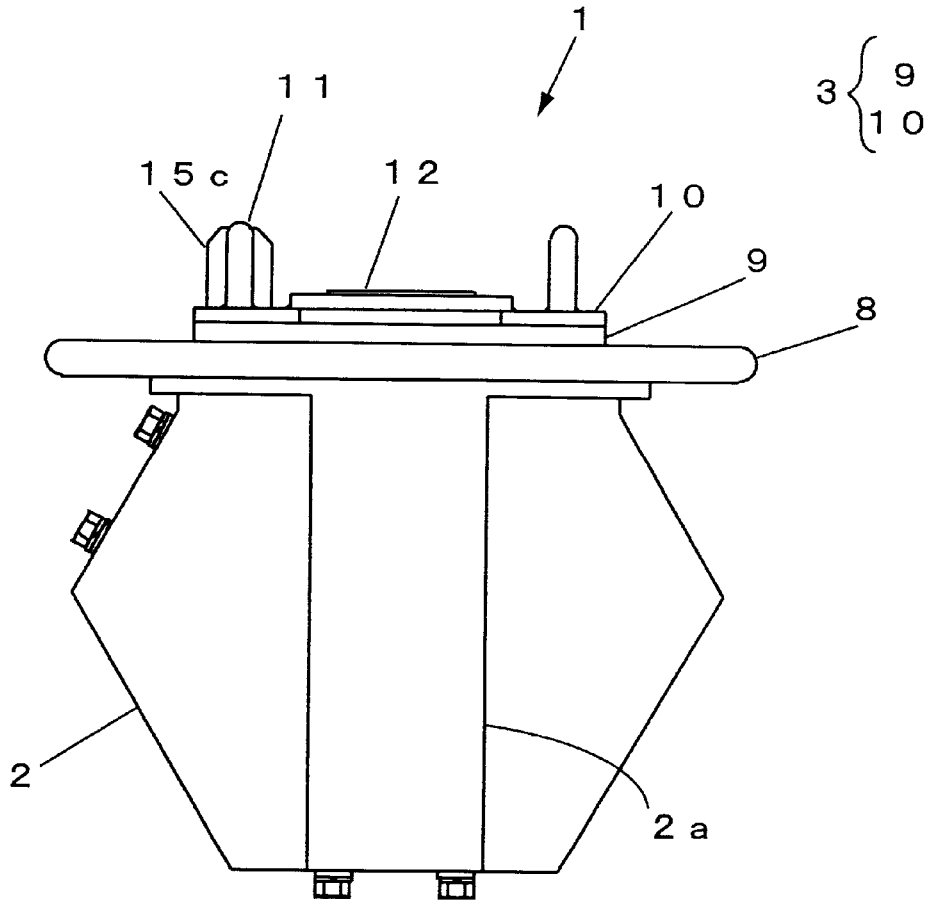
FIG. 3 is a side view of the barrel container.
Figure 4:
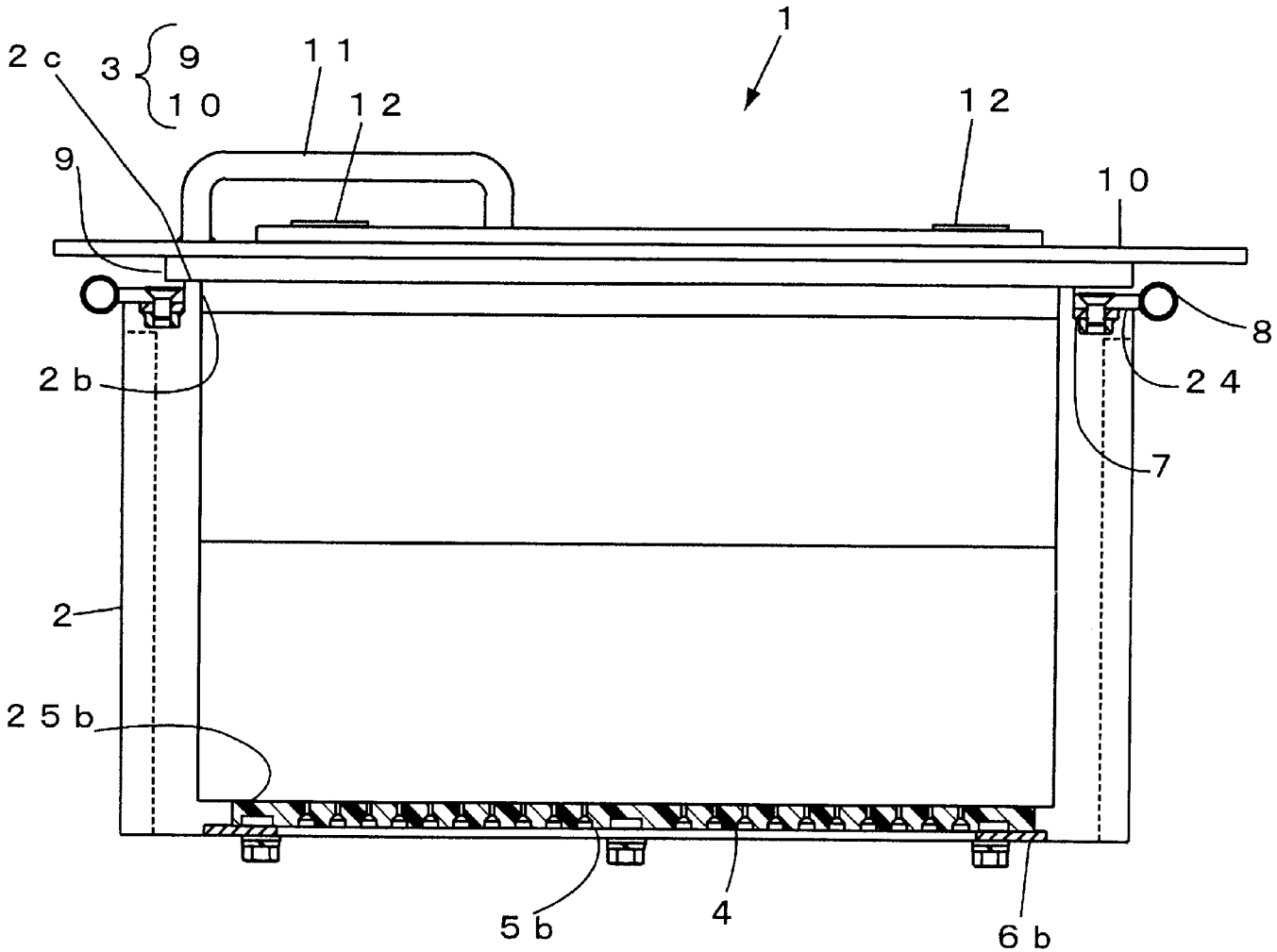
FIG. 4 is a sectional front view of the barrel container.
Figure 5:
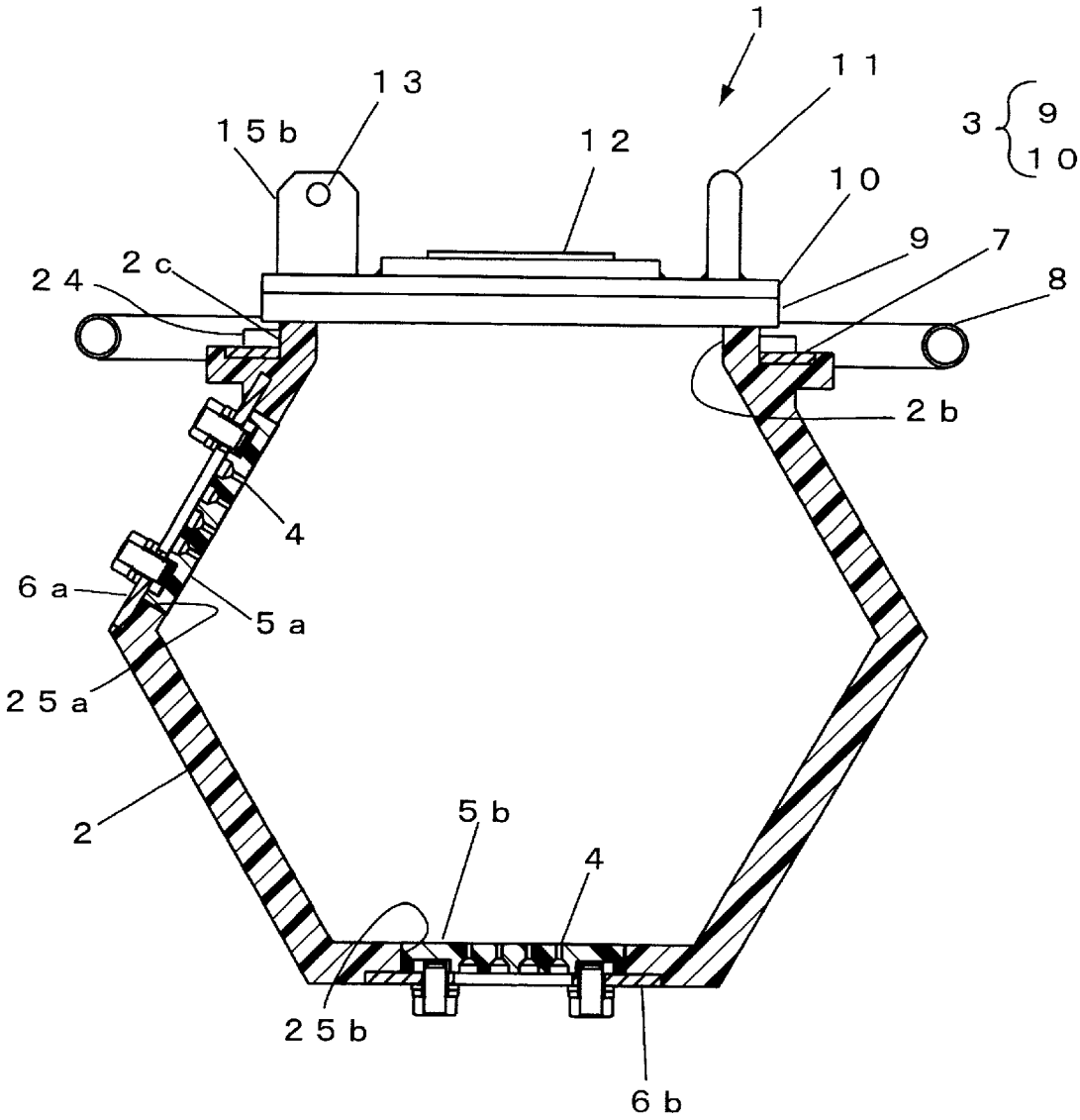
FIG. 5 is a sectional side view of the barrel container.

One embodiment of the present invention will be described with reference to FIGS. 1 to 5. Referring to FIG. 1, the barrel container 1 of the embodiment is shown. The barrel container 1 comprises a container body 2 and a lid 3. The container body 2 is made of an elastic material, for example, by molding from molten polyurethane resin. The polyurethane resin has a hardness of 70 in ISO 7619 Shore A durometer hardness. No water is used as a buffer in the dry barrel polishing. Accordingly, since workpieces violently collide against an inner wall of the container body 2, the workpieces easily incur marks due to the collision. However, the marks due to the collision can be reduced when the hardness of the container body 2 is set at such a value as described above. When the hardness of the container body 2 is less than 60 in ISO 7619 Shore A durometer hardness, the mechanical strength of the container body 2 is too low. When the hardness of the container body 2 exceeds 80, the marks on the workpieces due to the collision tend to be increased. Thus, the hardness of the container body 2 preferably ranges between 60 and 80 in ISO 7619 Shore A durometer hardness type A. Although the container body 2 is made of the polyurethane resin in the embodiment, a thermosetting resin solidified by the molding, such as a polyester resin, may be used instead of the polyurethane resin.

The container body 2 has a hexagonal section and accordingly includes six peripheral sides. Both ends of the container body 2 serve as thick portions 2*a* reinforcing the body. Two of the six peripheral sides are formed with vents 25*a* and 25*b*, respectively. Each vent is dimensioned so that polishing chips and/or workpieces are allowed to pass therethrough. Two steel plates 6*a* and 6*b* are embedded during molding so as to surround the vents 25*a* and 25*b* on the outer faces of the peripheral sides of the container body 2, respectively. Each of the plates 6*a* and 6*b* has a central opening. Two polyurethane pieces 5*a* and 5*b* are fixed to the plates 6*a* and 6*b* by bolts and nuts inside the casing body 2. Each of the pieces 5*a* and 5*b* has a number of small holes 4 through which the polishing chips and workpieces are not allowed to pass. The polyurethane pieces 5*a* and 5*b*, and the small holes 4 are also formed by the molding operation.

The container body 2 has an access opening 2*b* formed in one of the peripheral sides thereof. The polishing chips and workpieces are put through the opening 2*b* into the container body 2. The opening 2*b* has a peripheral edge protruding along its entirety. The protruding edge of the opening 2*b* serves as a seal 2*c* sealing the opening when the lid 3 is closed. A rectangular reinforcing frame 7 is embedded in the container body 2 during the molding operation so as to be disposed around the seal 2*c*. The frame 7 may or may not be provided. A connecting plate 24 is screwed to the frame 7. A carrying bar 8 is mounted on the plate 24.

Figure 9:
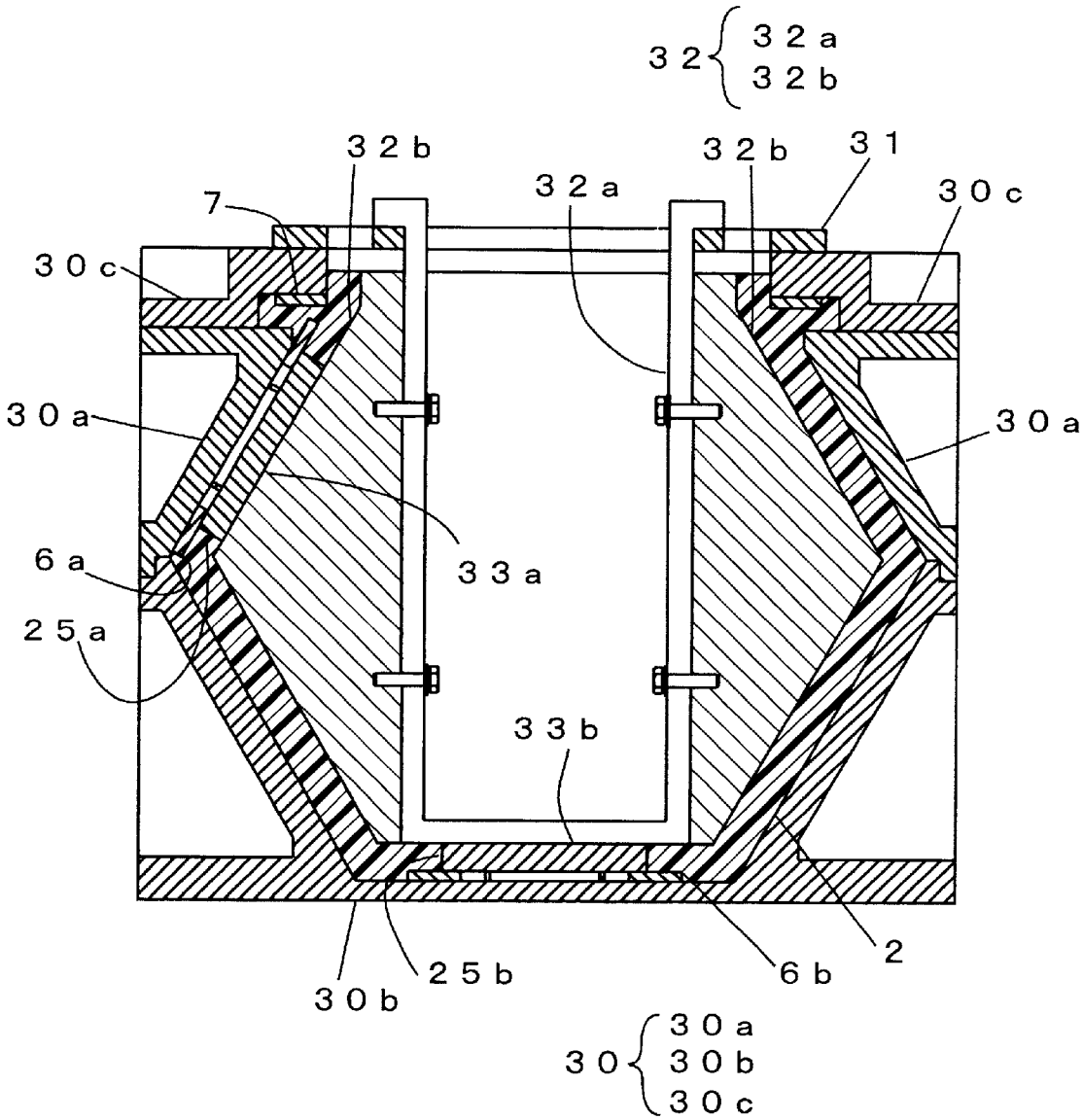
FIG. 9 is a sectional view of a container body of the barrel container, showing a manufacturing stage of the container body.
Figure 10:
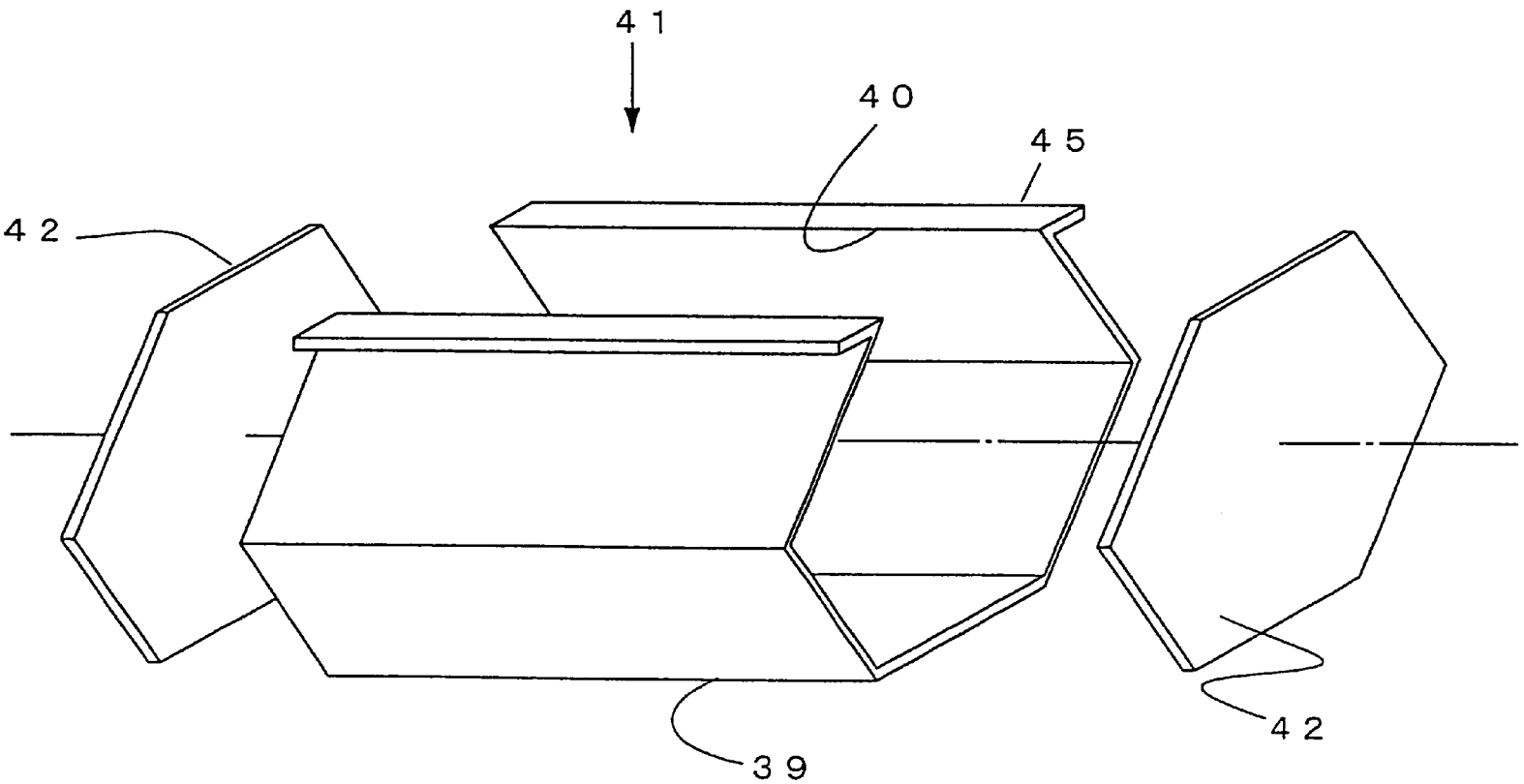
FIG. 10 PRIOR ART
FIG. 10 is a schematic exploded perspective view of a body of a conventional barrel container.
Figure 11:
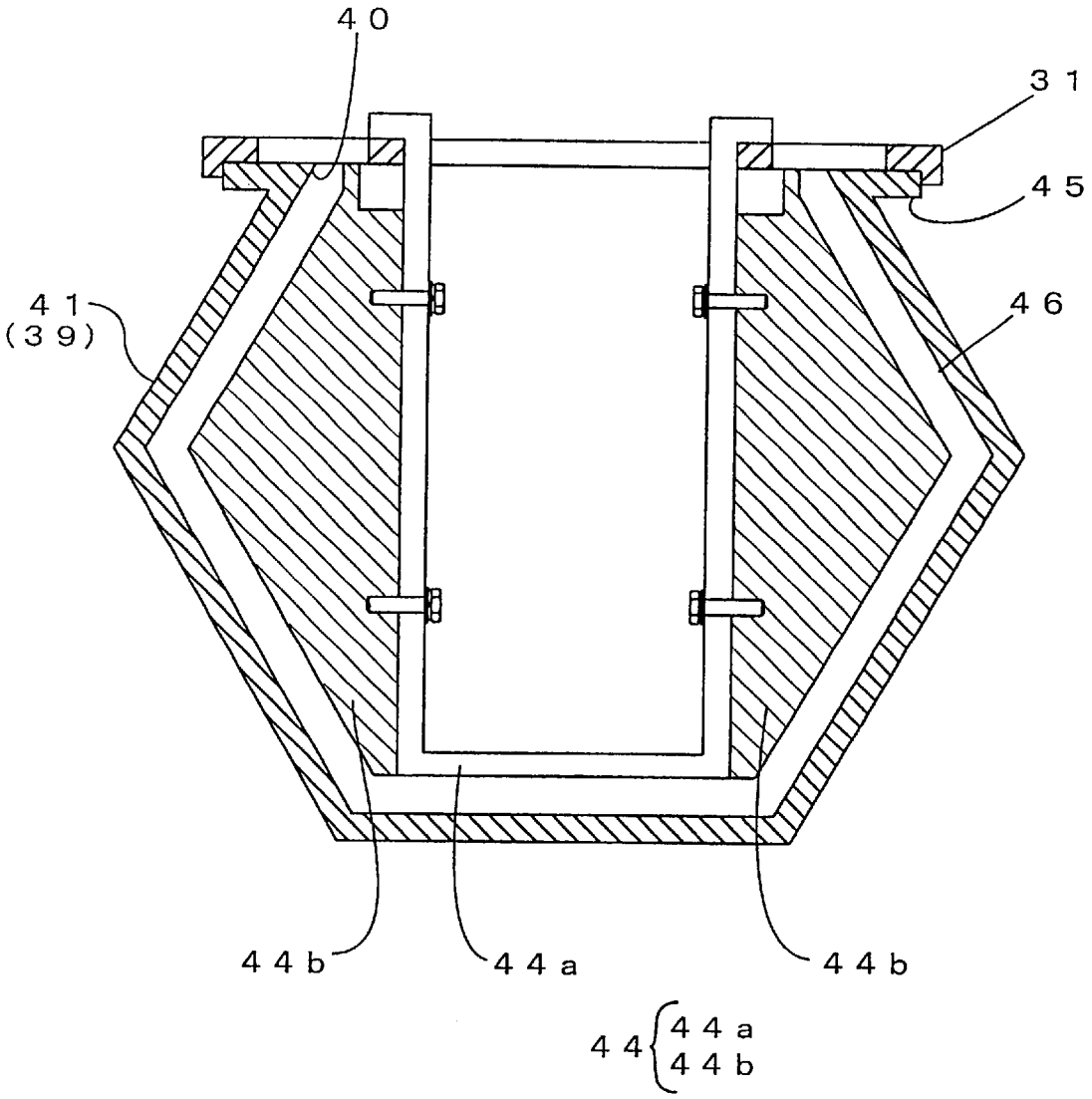
FIG. 11 PRIOR ART
FIG. 11 is a sectional view of the body in which a core is set.
Figure 12:
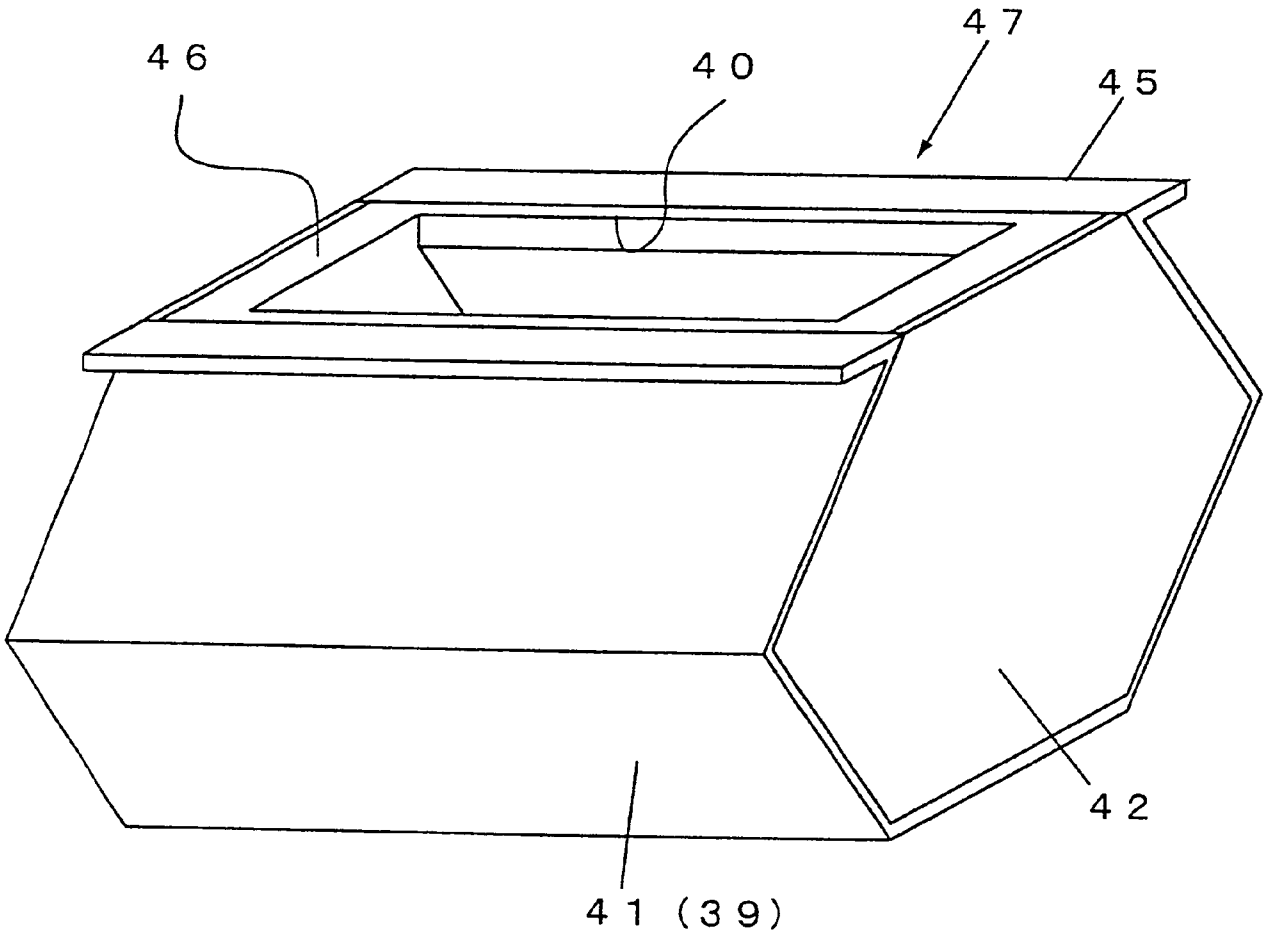
FIG. 12 PRIOR ART
FIG. 12 is a perspective view of the conventional barrel container with a lining attached thereto.
Figure 13B:
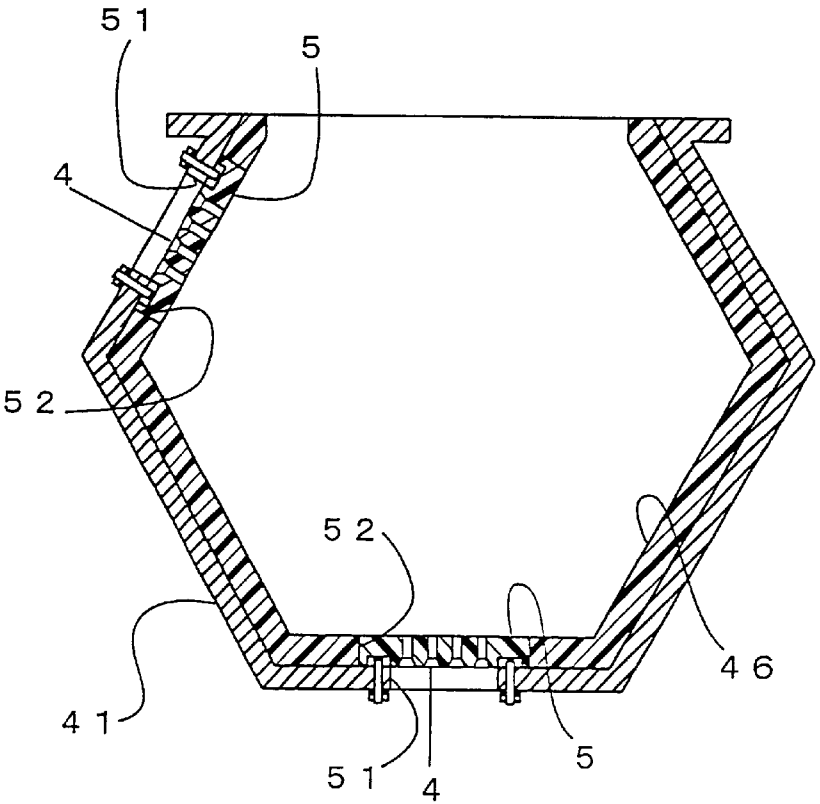
FIG. 13(b) PRIOR ART
FIGS. 13A and 13B are sectional views of a container body for the conventional barrel container.
Figure 13A:
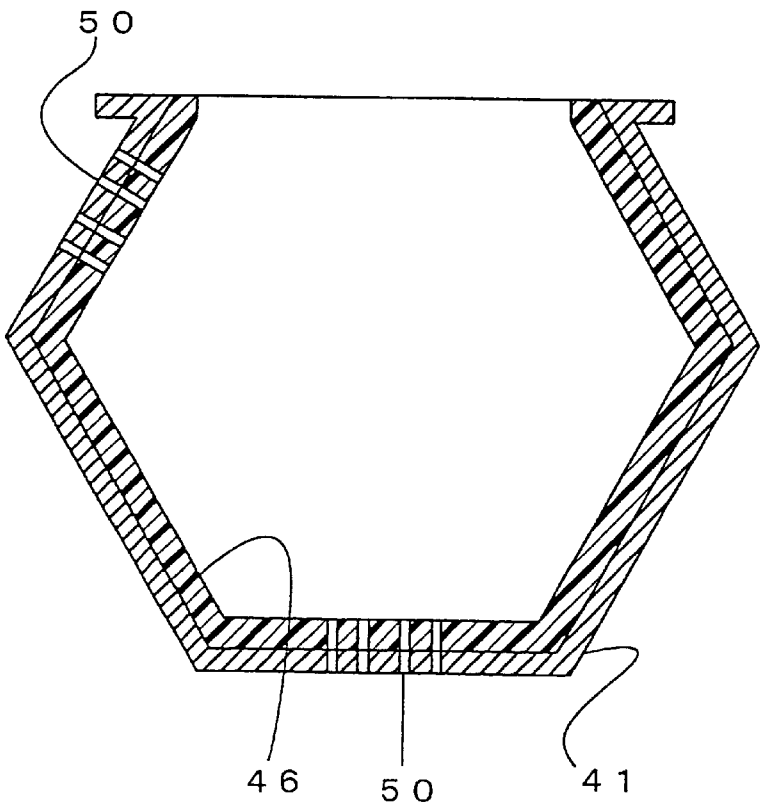
FIG. 13(a) PRIOR ART
Figure 14:
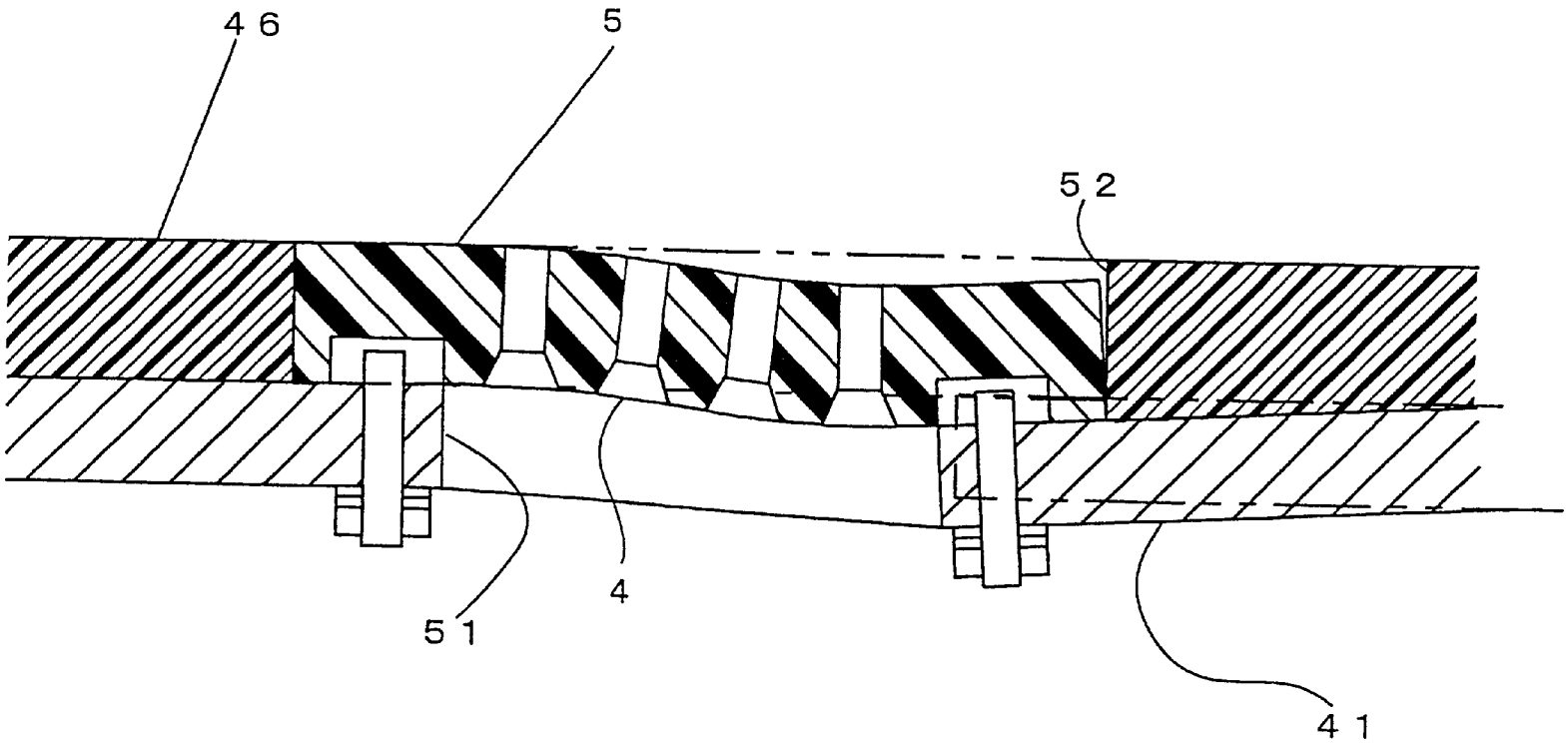
FIG. 14 PRIOR ART
FIG. 14 is a partially broken enlarged section of the container body.

The manufacture of the container body 2 will now be described with reference to FIG. 9. A metal mold 30 has an inner face conforming to a shape of the container body 2. The mold 30 is divided into pieces 30*a*, 30*b* and 30*c* when the molten resin solidified into the container body 2 is to be taken out of the mold. A bridge member 31 is mounted on an upper end of the mold 30. A core 32 is hung on the bridge member 31 as shown in FIG. 9. The core 32 is also divided into pieces 32*a* and 32*b* so that the solidified container body 2 can be taken out of the mold. The aforesaid plates 6*a* and 6*b* and frame 7 are fixed to the mold 30 by screws (not shown) so as to be located to correspond to the vents 25*a* and 25*b* and opening 2*b*, respectively. Dummy molds 33*a* and 33*b* are mounted on the plates 6*a* and 6*b* so as to be further mounted on the mold 30 to correspond to the vents 25*a* and 25*b*, respectively. The container body 2 has a thickness equal to an addition of a thickness of the dummy mold 33*a* or 33*b* and a thickness of the plate 6*a* or 6*b*.

The molten polyurethane resin is poured into the mold 30 when the bridge member 31, core 32, plates 6*a* and 6*b*, frame 7 and dummy molds 33*a* and 33*b* have been set on the mold 30. Upon solidification of the resin, the core 32, bridge member 31, mold 3*c*, dummy molds 33*a* and 33*b* are disassembled in this order so that the container body 2 is obtained.

The lid 3 will now be described in detail with reference to FIGS. 1 to 5. The lid 3 includes a base 10 made of a light-weight alloy such as an aluminum alloy. A lining 9 made of the same material as of the container body 2 is formed on an inside of the lid 3 by the molding ooperation. Two handholds 11 are mounted on an outside of the base 10. The lid 3 is pressed by a clamp shaft 21 when attached to the container body 2 to be closed. The lid 3 has two friction plates 12 attached to a surface of the lid 3 against which the clamp shaft 21 abuts. A locking mechanism 26 is provided on the base 10 for rotating the clamp shaft 21 for closure of the lid 3. The locking mechanism 26 includes a rod 13 and a compression coil spring 14 disposed about the rod between insertion plates 15*a* and 15*b* upstanding on the base 10. The spring 14 usually urges the rod 13 toward an insertion plate 15*c*.

Figure 6:
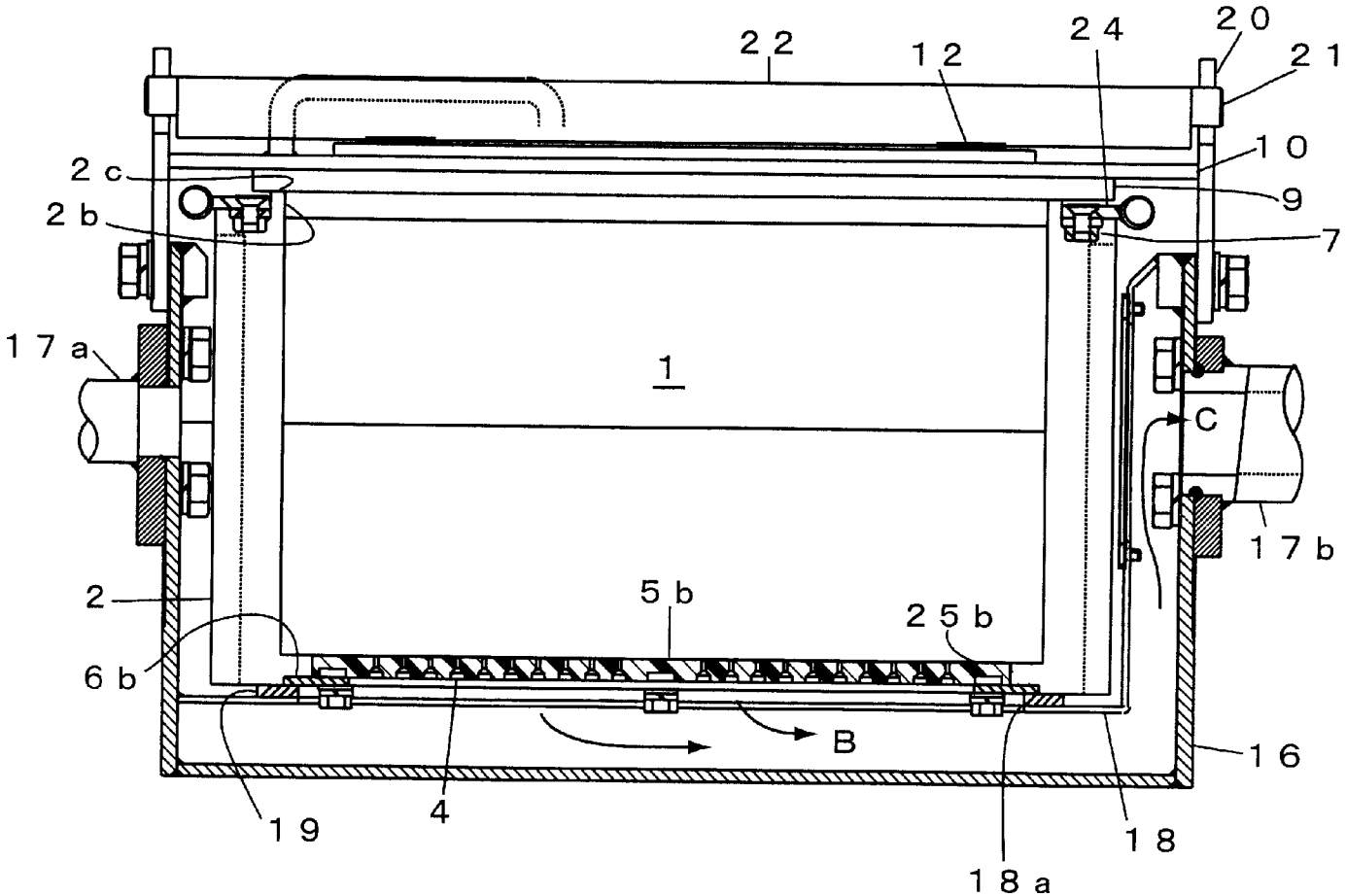
FIG. 6 is a sectional front view of a barrel casing enclosing the barrel container with a lid being attached to the barrel container.
Figure 7:
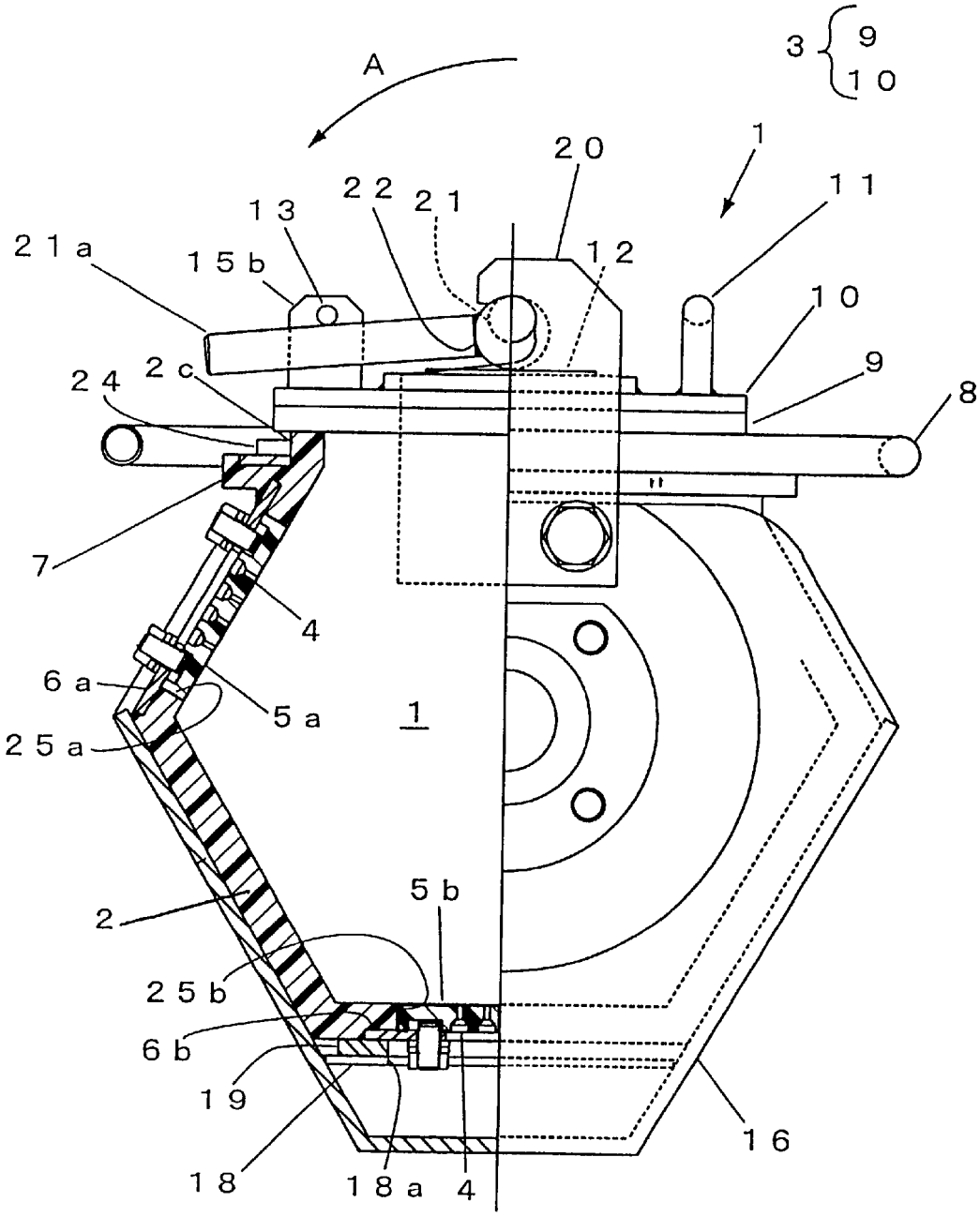
FIG. 7 is a partially sectional side view of the barrel casing enclosing the barrel container.
Figure 8:
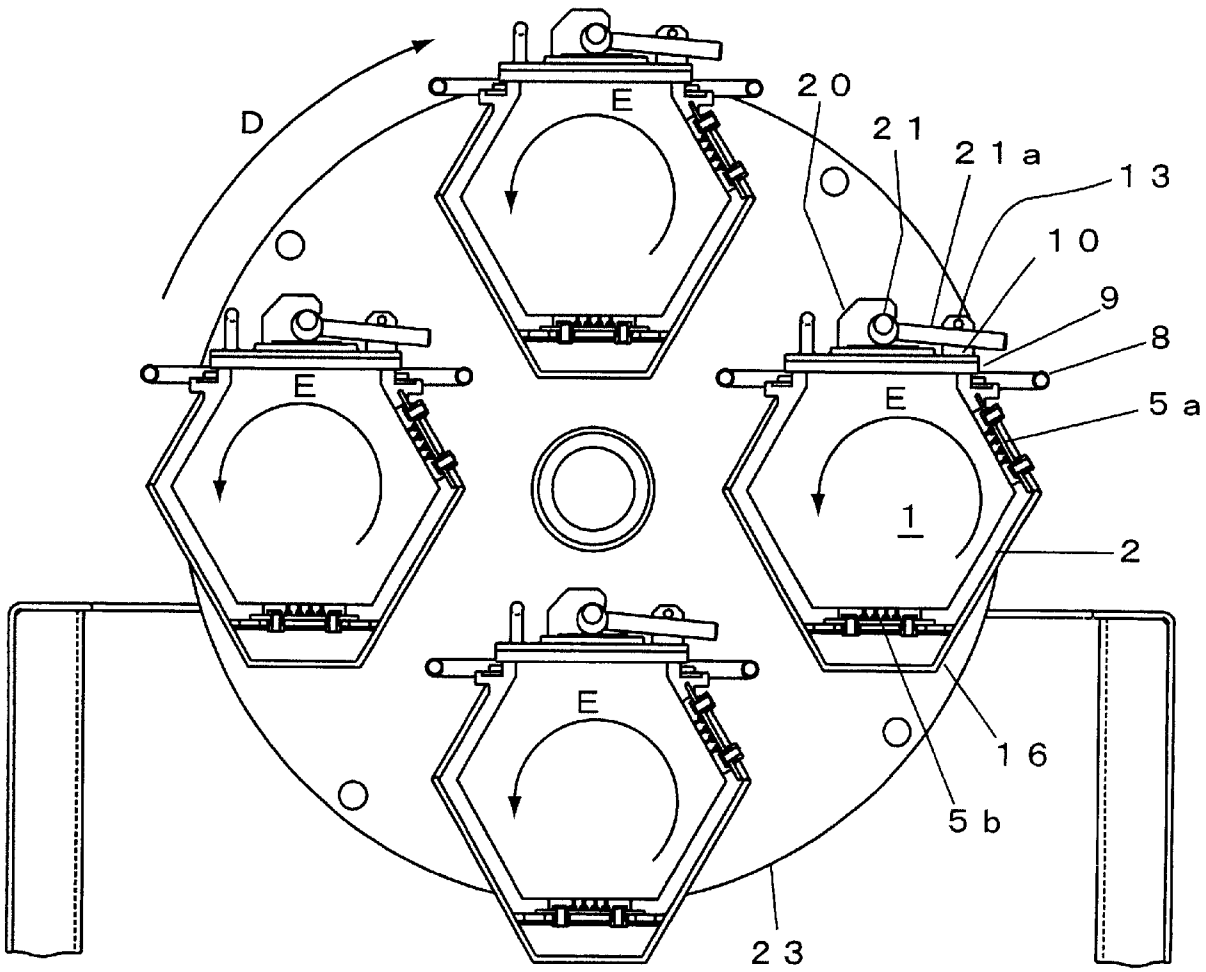
FIG. 8 is a sectional side view of a plurality of the barrel containers mounted on a turret.

FIGS. 6 and 7 illustrate a closing mechanism for the lid 3. Reference numeral 16 designates a barrel casing for accommodating the barrel container 1. The barrel casing 16 is mounted on a rotational shaft 17*a* and a hollow rotational shaft 17*b*, both of which shafts are disposed on a central axis of the barrel casing 16. A partition plate 18 is provided in the interior of the barrel casing 16 to be spaced from the bottom of the casing. The barrel container 1 is supported on the partition plate 18 with rectangular sponge rubber members 19 being interposed therebetween. The partition plate 18 has rectangular notches 18*a* each of which is located inside the sponge rubber member 19. A pair of side plates 20 are fixed to both upper ends of the barrel casing 16 by bolts so as to be perpendicular to the rotational shafts 17*a* and 17*b*, respectively. The clamp shaft 21 is rotatably supported between the side plates 20. The clamp shaft 21 includes a rotational shaft and an eccentric cam 22 fitted with the shaft and extending substantially an entire length of the shaft. When the clamp shaft 21 is inserted into the side plates 20 and a central shaft 21*a* is then held to be rotated in the direction of arrow A, a protruding end of the eccentric cam 22 presses the friction plate 12 of the lid 3, closing the lid 3 against the container body 2. In this case, the sponge rubber members 19 are compressed such that airtightness is effected between the barrel container 1 and the partition plate 18. For example, four barrel casings 16 accommodating the respective barrel containers 1 are rotatably mounted on two revolving circular turrets 23 so as to be arranged along circumferences of the turrets at regular intervals, as shown in FIG. 8.

The following describes a case where workpieces are polished using the barrel container 1. Workpieces and polishing chips are put through the opening 2*b* into the container body 2. The barrel container 1 is then enclosed in the barrel casing 16, and the lid 3 is placed on the opening 2*b*. The clamp shaft 21 is inserted into the side plates 20, and the shaft 21*a* is then held to be rotated in the direction of arrow A so that the barrel container 1 is fixed to the barrel casing 16. The rod 13 of the locking mechanism 26 is previously retreated against the spring 14 when the rod 13 is returned after the shaft 21*a* has been rotated, the shaft 21*a* is fixed by the rod 13, whereupon rebound of the shaft is prevented. When the turrets 23 are revolved in the direction of arrow D in FIG. 8 and the shafts 17*a* and 17*b* are rotated in the direction of arrow E in FIG. 8, the workpieces are polished in each barrel container 1 as the result of revolution of the turrets 23 and rotation of each barrel container 1.

The barrel container 1 has two vents 25*a* and 25*b*. The vent 25*b* confronts the partition plate 18, and the partition plate 18 has the notches 18*a*. Accordingly, the interior of the barrel container 1 communicates via the space at the underside of the partition plate 18 with the hollow interior of the shaft 17*b*. A distal end of the shaft 17*b* is connected to a dust collector (not shown), which is driven during polishing so that air is drawn from the barrel container 1. As a result, shavings due to the polishing and dust are discharged through the small holes 4 of the polyurethane piece 5*b* attached to the vent 25*b*. The air is further fed through the exhaust passages B and C into the dust collector. In this case, since the sponge rubber members 19 are compressed such that airtightness is effected between the barrel container 1 and the partition plate 18, the air smoothly flows through the passages B and C. On the other hand, air is introduced through the small holes 4 of the polyurethane piece 5*a* of the vent 25*a* into the barrel container 1, so that an atmosphere in the barrel container 1 is cooled. Thus, the loading of the polishing chips can be prevented as the result of the above-described discharge of dust due to polishing and cooling the atmosphere in the barrel container 1. Furthermore, the workpieces can desirably be polished without adherence of soil thereto.

The polyurethane pieces 5*a* and 5*b* are fixed by bolts to the plates 6*a* and 6*b*, respectively, in the foregoing embodiment. However, the plates 6*a* and 6*b* may or may not be provided, and the polyurethane pieces 5*a* and 5*b* may be mounted directly on the casing body 2. Further, the barrel container 1 is mounted on the machine for both revolving and rotating movement. However, the barrel container 1 may be mounted on a rotary barrel polishing machine for only rotation of the barrel container 1. Additionally, the number of the vents may be one, two, or more than two, only if air can be introduced into the barrel container and dust, due to polishing, discharged from the barrel container.

According to the above-described embodiment, the container body of the barrel container is made by the molding operation without using the conventional steel casing body. Accordingly, the thickness of the container body is uniform although the container body is formed with the vents. There is no difference in the thickness even when a piece having the same thickness and formed with small holes is subsequently attached to the container body. Furthermore, since the container body is made of the elastic material such the polyurethane resin, it is light-weight, and a load for carrying the barrel container can be reduced. Furthermore, when made of the polyurethane resin with high wear and abrasion resistance, the barrel container can be used for a long period of time. Moreover, since the container body of the barrel container 1 has a larger thickness than the lining of the conventional container body made of steel, the service life of the barrel container can further be improved. Additionally, the polyurethane has a hardness ranging between 60 and 80 in ISO 7619 shore A durometer hardness. Consequently, shock due to the collision of workpieces against the inner wall of the container body can be reduced during the dry barrel polishing as compared with the case of the wet barrel treatment. Thus, the marks due to the collision can be reduced.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

I claim:

1. A barrel container for a dry barrel polishing machine, comprising:

a container body made of an elastic material and having an access opening through which polishing chips and workpieces are to be put into said container body, said container body having a wall with through holes providing communication between an exterior and an interior of said container body;

a lid for opening and closing said access opening; and pieces made of an elastic material and having a number of small holes, said pieces being attached to respective said through holes of said container body.

2. The barrel container according to claim 1, wherein said elastic material of said container body comprises polyurethane.

3. The barrel container according to claim 2, wherein said polyurethane has a hardness ranging between 60 to 80 in ISO 7619 Shore A durometer hardness.

4. The barrel container according to claim 1, further comprising:

a barrel casing enclosing said container body with a space defined in said barrel casing so as to communicate via said small holes with the interior of said container body; and a hollow shaft supporting said barrel casing so that said barrel container is rotatable, said shaft having a communication passage defined therein so as to provide communication between the space in said barrel casing and a dust collector.

5. The barrel container according to claim 4, wherein said container body has a hexagonal section and said wall has two peripheral sides adjacent to said access opening and a bottom, said bottom and one of said two peripheral sides having said through holes, and said through holes having said pieces, respectively, said bottom communicating with the space in said barrel casing for exhaust of air, and said one of said two peripheral sides communicating via said barrel casing with an exterior of said barrel casing for intake of air.

6. The barrel container according to claim 1, wherein said container body is made of an elastic material by being molded from molten elastic material.

7. A barrel container for a dry barrel polishing machine, comprising:

a container body made of an elastic material and having an access opening through which polishing chips and workpieces are to be put into said container body, said container body having a wall with through holes providing communication between an exterior and an interior of said container body;

a lid for opening and closing said access opening;

pieces made of an elastic material and having a number of small holes, said pieces being attached to respective said through holes of said container body; and air-permeable plates mounted on an outside of said container body so as to cover respective said through holes of said container body, wherein said pieces are bolted to respective said plates at an inside of said container body.

8. The barrel container according to claim 7, wherein said elastic material of said container body comprises polyurethane.

9. The barrel container according to claim 8, wherein said polyurethane has a hardness ranging between 60 to 80 in ISO 7619 Shore A durometer hardness.

10. The barrel container according to claim 7, further comprising:

a barrel casing enclosing said container body with a space defined in said barrel casing so as to communicate via said small holes with the interior of said container body; and a hollow shaft supporting said barrel casing so that said barrel container is rotatable, said shaft having a communication passage defined therein so as to provide communication between the space in said barrel casing and a dust collector.

11. The barrel container according to claim 10, wherein said container body has a hexagonal section and said wall has two peripheral sides adjacent to said access opening and a bottom, said bottom and one of said two peripheral sides having said through holes, and said through holes having said pieces, respectively, said bottom communicating with the space in said barrel casing for the exhaust of air, and said one of said two peripheral sides communicating via said barrel casing with an exterior of said barrel casing for intake of air.

12. The barrel container according to claim 7, wherein said container body is made of an elastic material by being molded from molten elastic material.

* * * * *